US007029252B2

(12) United States Patent
Masuda et al.

(10) Patent No.: US 7,029,252 B2
(45) Date of Patent: Apr. 18, 2006

(54) ROTARY COMPRESSOR

(75) Inventors: Masanori Masuda, Sakai (JP); Katsumi Kato, Sakai (JP); Yoshitaka Shibamoto, Sakai (JP)

(73) Assignee: Dakin Industries, Ltd, Osaka (JP)

( * ) Notice: Subject to any disclaimer, the term of this patent is extended or adjusted under 35 U.S.C. 154(b) by 147 days.

(21) Appl. No.: 10/467,279

(22) PCT Filed: Feb. 24, 2003

(86) PCT No.: PCT/JP03/01998

§ 371 (c)(1),
(2), (4) Date: Aug. 6, 2003

(87) PCT Pub. No.: WO03/078842

PCT Pub. Date: Sep. 25, 2003

(65) Prior Publication Data

US 2005/0008519 A1 Jan. 13, 2005

(30) Foreign Application Priority Data

Mar. 18, 2002 (JP) ..... 2002-074052

(51) Int. Cl.
*F04C 18/356* (2006.01)
*F04C 18/02* (2006.01)
*F03C 2/00* (2006.01)

(52) U.S. Cl. ..... 418/63; 418/59; 418/66

(58) Field of Classification Search ..... 418/63, 418/64, 66, 59

See application file for complete search history.

(56) References Cited

U.S. PATENT DOCUMENTS 6,206,661 B1 3/2001 Iida et al.

FOREIGN PATENT DOCUMENTS

| | | | |
|---|---|---|---|
| FR | 1238461 | | 8/1960 |
| JP | 59-147893 | | 8/1984 |
| JP | 05248381 A | * | 9/1993 |
| JP | 05248382 A | * | 9/1993 |
| JP | 5-312169 | | 11/1993 |
| JP | 05312171 A | * | 11/1993 |
| JP | 9-88852 | | 3/1997 |
| JP | 10009167 A | * | 1/1998 |
| JP | 2001-254688 | | 9/2001 |

* cited by examiner

*Primary Examiner*—Theresa Trieu
(74) *Attorney, Agent, or Firm*—Shinjyu Global IP Counselors

(57) ABSTRACT

The outer peripheral surface of a swing piston is formed in a non-circular form. The inner peripheral surface of a cylinder chamber is formed on a basis of an envelope curve of the outer peripheral surface of the swing piston obtained at the time of its swing. The outer peripheral surface of the swing piston and the inner peripheral surface of the cylinder chamber are formed in, e.g., an ovoid shape so that as compared to a rotary compressor in which such inner and outer peripheral surfaces are formed in a circular form, a shorter compression cycle and a longer discharge cycle is obtained during movement of the swing piston. As a result, an overcompression loss when a refrigerant is discharged in a swing compressor is reduced.

8 Claims, 8 Drawing Sheets

(a)

(b)

(c)

(a)

(b)

ROTARY COMPRESSOR

BACKGROUND OF THE INVENTION

The present invention relates to a rotary compressor, and in particular to, a swing type (piston swing type) rotary compressor that a swing piston is rotated orbitally within a cylinder chamber while a blade which is integrally provided with the swing piston being held by a cylinder and swung.

A swing compressor with a swing piston has been conventionally known as a rotary compressor as is disclosed in, for example, Japanese Patent Application Laid-Open (JP-A) No. 9-88852. The swing compressor is usually used in order to compress a gas refrigerant in a refrigerant circuit for a refrigerating machine.

In general, a swing compressor is structured so that its compression mechanism has a schematic horizontal sectional structure as shown in FIG. 8. A compression mechanism (100) comprises a cylinder (102) confining a cylinder chamber (101), a drive shaft (103) disposed so as to penetrate the cylinder chamber (101) and a swing piston (104) which is fitted into an eccentric shaft portion (103*a*) of the drive shaft (103) and thus accommodated within the cylinder chamber (101). The cylinder chamber (101) is formed so as to have a circular cross-sectional configuration. The drive shaft (103) is disposed concentrically with the cylinder chamber (101). The center of the eccentric shaft portion (103*a*) is eccentric from the center of the cylinder chamber (101).

A blade (104*a*) is formed integrally with the swing piston (104). The blade (104*a*) is connected via a swing bush pair (105) to the cylinder. Specifically, the swing piston (104) is supported to a free swing about the center of axis of a bush hole (102*a*) with circular cross-sectional configuration by the blade (104*a*) being inserted into the bush hole (102*a*) together with the swing bush pair (105) with substantially semi-circular form with interposed between the pair of swing bushes (105).

Further, the blade (104*a*) is supported so as to advance and retreat with respect to the bush pair (105) in the direction of its surface (i.e., in the radial direction of the swing piston (104)). The swing piston (104) is fitted in a free sliding into the eccentric shaft portion (103*a*) and rotated orbitally along the inner peripheral surface of the cylinder (102) without rotating on its own axis by rotation of the eccentric shaft portion (103*a*).

The cylinder chamber (101) is divided, by the swing piston (104) and the blade (104*a*), into a suction chamber (106) into which a refrigerant with low pressure is suctioned and a compression chamber (107) for compressing a suctioned refrigerant. A suction port (108) communicating with the suction chamber (106) and a discharge port (109) communicating with the compression chamber (107) are formed in the cylinder (102). A discharge valve (110) is attached to the exit of the discharge port (109). The discharge valve (110) is opened when a discharge pressure within the compression chamber (107) reaches a predetermined level.

In accordance with the swing compressor with the above-described structure, by the eccentric shaft portion (103*a*) being rotated, the swing piston (104) is rotated orbitally within the cylinder chamber (101) while the blade (104*a*) is swung, and thus a gas refrigerant suctioned into the cylinder chamber (101) is compressed and discharged by the cylinder chamber volume being varied. Specifically, in accordance with the swing compressor, when a pressure within the cylinder chamber (101) reaches a discharge pressure by a compression cycle performed in the first phase of the orbital movement of the swing piston (104), the differential pressure between inside the cylinder chamber (101) and outside the same reaches a predetermined value, so that the discharge valve (110) is opened. Then, a discharge cycle starts and the refrigerant is discharged.

A conventional swing compressor has the problem that an overcompression loss for a refrigerant becomes relatively large and thus a compression efficiency is decreased. Causes for this problem are as follows. Namely, in accordance with a conventional swing compressor, the position of the swing piston (104) when the discharge valve (110) is opened is usually positioned slightly over a bottom dead center as illustrated in an imaginary line shown in FIG. 8. The discharge cycle is performed in a relatively narrow angular range from this position to a vicinity of top dead center. Namely, in accordance with a conventional swing compressor, because of this relatively narrow angular range, the discharge cycle is performed in a short time and thus the flow rate of the discharged gas is increased. As a peak pressure is increased, an over compression loss for a refrigerant becomes large. As a result, the efficiency of compressor is decreased.

The present invention was developed in light of such problems and an object of the present invention is to reduce an overcompression loss generated when a refrigerant is discharged in a swing compressor and thus to prevent a decrease in efficiency.

SUMMARY OF THE INVENTION

In accordance with the present invention, the swing piston (28) and the cylinder chamber (25) are formed in non-circular forms that a longer discharge cycle can be performed, so that over compression is reduced.

Specifically, in accordance with first and second aspects, it is presupposed to provide a rotary compressor which comprises a compression mechanism (20) that a swing piston (28) is rotated orbitally within a cylinder chamber (25) while a blade (28*b*) integrally provided with the swing piston (28) is held by a cylinder (19) and swung.

In accordance with the rotary compressor of the first aspect, the outer peripheral surface of the swing piston (28) is formed in a non-circular form and the inner peripheral surface of the cylinder chamber (25) is formed on a basis of an envelope curve of the outer peripheral surface of the swing piston (28) at the time of swing of the swing piston (28), and the outer peripheral surface of the swing piston (28) and the inner peripheral surface of the cylinder chamber (25) are formed in configurations that as compared to the case in which the outer and inner peripheral surfaces are formed in a circular form, a shorter compression cycle and a longer discharge cycle can be obtained during the movement of the swing piston (28).

In accordance with the rotary compressor of the second aspect, the inner peripheral surface of the cylinder chamber (25) is formed in a non-circular form and the outer peripheral surface of the swing piston (28) is formed on a basis of an envelope curve of the inner peripheral surface of the cylinder chamber (25) at the time of swing of the swing piston (28), the outer peripheral surface of the swing piston (28) and the inner peripheral surface of the cylinder chamber (25) are formed in configurations that as compared to the case in which the outer and inner peripheral surfaces are formed in a circular form, a shorter compression cycle and a longer discharge cycle can be obtained during the movement of the swing piston (28).

In accordance with first and second aspects, the blade (28*b*) integrally formed with the swing piston (28) is held to be swingable by the cylinder (19). Thus, the cylinder chamber (25) is divided into the suction chamber (25*a*) and the compression chamber (25*b*) by the blade (28*b*). When the swing piston (28) is rotated orbitally within the cylinder chamber (25) while the blade (28*b*) being swung, volumes of the suction chamber (25*a*) and the compression chamber (25*b*) are varied. Then, a suction cycle is performed in the suction chamber (25*a*), and a compression cycle and a discharge cycle are performed in the compression chamber (25*b*).

When the suction cycle is completed in the suction chamber (25*a*) during movement, the suction chamber (25) now becomes the compression chamber (25*b*) and then the compression cycle starts. Because of the outer peripheral surface of the swing piston (28) and the inner peripheral surface of the cylinder chamber (25) being formed in the above-described configuration, as compared to the case in which such peripheral surfaces are formed in a circular form, the compression cycle ends earlier and the discharge cycle is performed for a longer time. As described above, the discharge cycle is performed for a relatively longer time and thus the flow rate of a discharged gas is decreased. Further, a resistance is also decreased. As a result, overcompression is reduced as compared to the case in which such peripheral surfaces are formed in a circular form.

In accordance with a third aspect, in the rotary compressor of the first aspect, the outer peripheral surface of the swing piston (28) is formed on a basis of a curved configuration that its suction side (28*a*(s)) with respect to the blade (28*b*) is even further protruded radially outward than its discharge side (28*a*(d)).

In accordance with a fourth aspect, in the rotary compressor of the third aspect, the outer peripheral surface of the swing piston (28) is formed so that its discharge side (28*a*(d)) with respect to the blade (28*b*) is formed on a basis of a complete round.

In accordance with a fifth aspect, in the rotary compressor of the first aspect, the outer peripheral surface of the swing piston (28) is formed on a basis of a spiral configuration so that its diameter is gradually reduced from its suction side (28*a*(s)) with respect to the blade (28*b*) to its discharge side (28*a*(d)).

In accordance with a sixth aspect, in the rotary compressor of the fifth aspect, the outer peripheral surface of the swing piston (28) is formed on a basis of an involute curve.

In accordance with the third through sixth aspects, the configuration of the swing piston (28) of the rotary compressor of the first aspect is specified, and the operation of the rotary compressor relating to the third through sixth aspects is the same as that of the rotary compressor of the first aspect. Accordingly, as a discharge cycle is performed for a relatively longer time, the flow rate of a discharged gas is decreased and a resistance is also decreased. As a result, overcompression can be suppressed as compared to the case of using a circular swing piston (28).

In accordance with a seventh aspect, in the rotary compressor of any one of the third through sixth aspects, the swing piston (28) is provided with a clearance portion (28*c*, 28*d*) at its suction side even further protruding than the discharge side (28*a*(d)).

In accordance with an eighth aspect, in the rotary compressor of any one of the third through sixth aspects, the swing piston (28) is provided with a balance weight (28*e*) at its discharge side (28*a*(d)) less protruding than the suction side (28*a*(s)).

In accordance with the seventh and eighth aspects, the suction side (28*a*(s)) of the swing piston (28) is even further protruded than its discharge side (28(d)). The clearance portion (28*c*, 28*d*) is formed at the even further protruding suction side (28*a*(s)). Alternatively, the balance weight (28*e*) is formed at the less protruding discharge side (28*a*(d)). Thus, the suction side (28*a*(s)) is balanced with the discharge side (28*a*(d)). Consequently, the rotation of the swing piston (28) is stabilized.

In accordance with a ninth aspect, in the rotary compressor of any one of the third through sixth aspects, two swing pistons (28, 28) are disposed along a direction of a shaft axis so that their suction sides (28(s)) oppose with each other with respect to the center of the shaft.

In accordance with the ninth aspect, two swing pistons (28) are disposed on a shaft so that their suction sides (28*a*(s)) oppose with each other. Thus, a rotational balance can be obtained and more stable movement can be accomplished.

As described above, in accordance with the first and second aspects, the outer peripheral surface of the swing piston (28) and the inner peripheral surface of the cylinder chamber (25) are formed in non-circular forms that as compared to the case in which such peripheral surfaces are formed in a circular form, a compression cycle ends earlier and a discharge cycle is performed for a longer time. Thus, overcompression can be suppressed. Further, an increased power loss caused by the overcompression can be prevented and thus a decrease in compression efficiency can be also prevented.

In accordance with the third aspect, the swing piston (28) is formed on a basis of a curved configuration such as an ellipse so that its suction side (28*a*(s)) with respect to the blade (28*b*) is even further protruded than its discharge side (28*a*(d)). Thus, overcompression can be suppressed and a decrease in efficiency can be prevented. Even when the swing piston (28) is formed in such configuration, the inner peripheral surface of the cylinder chamber (25) is formed on a basis of an envelope curve obtained at the time of swing of the swing piston (28). Consequently, the movement of the swing piston (28) is ensured.

In accordance with the fourth aspect, the outer peripheral surface of the swing piston (28) is formed so that the discharge side (28*a*(d)) with respect to the blade (28*b*) is formed on a basis of a complete round. In the cylinder chamber (25), as the swing piston (28) is swung toward the discharge side, the differential pressure between the suction chamber (25*a*) and the compression chamber (25*b*) becomes large, so that a sealing property at the discharge side is required. When the discharge side (28*a*(d)) is formed in a non-circular form, accuracy of forms of the swing piston (28) and the cylinder chamber (25) are hardly obtained. In contrast, when the discharge side (28*a*(d)) is formed on a basis of a complete round, required accuracy of forms can be easily obtained and thus the sealing property is improved.

In accordance with fifth aspect, the outer peripheral surface of the swing piston (28) is formed on a spiral configuration so that its diameter is gradually reduced from the suction side (28*a*(s)) with respect to the blade (28*b*) to the discharge side (28*a*(d)). Also in this case, overcompression can be suppressed as compared to the case of using a circular swing piston. Thus, an increased power loss caused by the overcompression can be prevented and a decrease in compression efficiency can be also prevented.

In accordance with the sixth aspect, the outer peripheral surface of the swing piston (28) is formed on a basis of an involute curve. As the involute curve leads to excellent workability, the required accuracy of form of the overall swing piston (28) is easily obtained. Further, a sealing property is improved.

In accordance with the seventh aspect, the clearance portion (28*c*, 28*d*) is formed at the suction side (28*a*(s)) of the swing piston (28) even further protruding than the discharge side (28*a*(d)) thereof. Thus, the balanced swing piston (28) can be provided with a simple structure and a stabilized movement can be obtained.

In accordance with the eighth aspect, the balance weight (28*e*) is provided at the discharge side (28*a*(d)) of the swing piston (28) less protruding than the suction side (28*a*(s)). Consequently, the balance of the swing piston (28) can be ensured and a stabilized movement can be obtained.

In accordance with the ninth aspect, two sing swing pistons (28, 28) on the same shaft are disposed so that their suction sides (28*a*(s)) oppose with each other with respect to the center of the shaft. Thus, the balance of the swing pistons can be ensured and a more stabilized movement can be performed.

BEST MODE FOR CARRYING OUT THE INVENTION

First Embodiment

Figure 1:
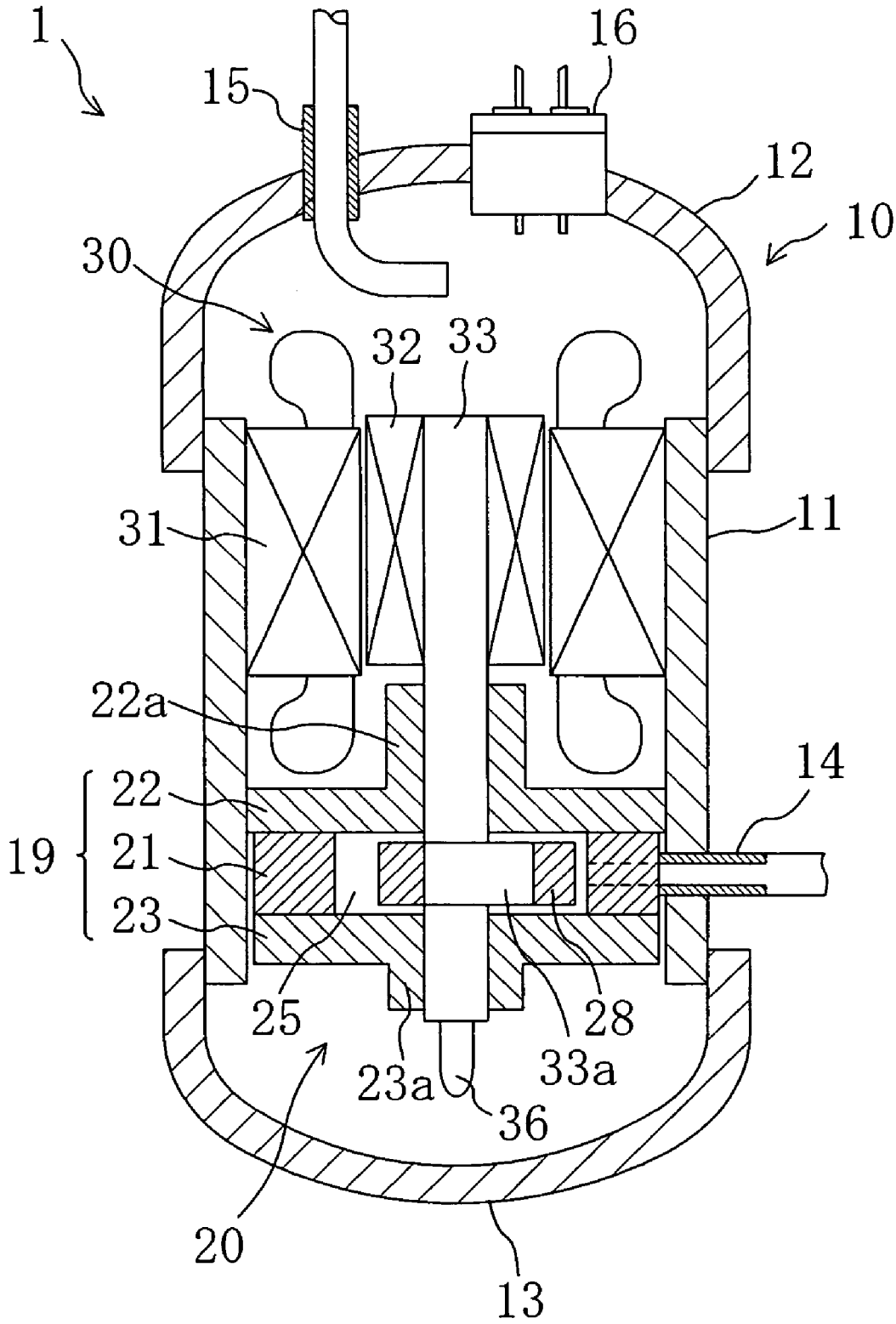
FIG. 1 is a cross-sectional structural view of a swing compressor relating to an first embodiment of the present invention.

An first embodiment of the present invention will be described in detail hereinafter with reference to the drawings.

As shown in FIGS. 1 and 2A through 2D, a rotary compressor (1) relating to the first embodiment is a so-called swing compressor. In accordance with the swing compressor (1), a compression mechanism (20) and a compressor motor (30) are accommodated within a casing (10). Further, the swing compressor is structured in a hermetic sealed type. The swing compressor (1) is provided in, for example, a refrigerant circuit for an air conditioning system. The swing compressor (1) suctions a refrigerant, compresses the same and then discharges a compressed refrigerant.

The casing (10) is formed by a cylindrical trunk portion (11) and end plates (12, 13) respectively fixed to the upper end portion and the lower end portion of the trunk portion (11). A suction pipe (14) penetrating the trunk portion (11) is provided at a predetermined lower position of the trunk portion (11). A discharge pipe (15) communicating the inside of the casing (10) with the outside thereof and a terminal (16) connected to an unillustrated external power source for supplying power to the compressor motor (30) are provided at the upper end plate (12).

The compression mechanism (20) is disposed at the lower side within the casing (10). The compression mechanism (20) comprises a cylinder (19) and a swing piston (28) which is accommodated within a cylinder chamber (25) of the cylinder (19). The cylinder (19) is formed by an annular cylinder portion (21), a front head (22) closing the upper opening of the cylinder portion (21) and a rear head (23) closing the lower opening of the cylinder portion (21). The cylinder chamber (25) is confined by the inner peripheral surface of the cylinder portion (21), the lower end surface of the front head (22) and the upper end surface of the rear head (23).

The compressor motor (30) has a stator (31) and a rotor (32). The stator (31) is fixed to the trunk portion (11) of the casing (10) upward of the compression mechanism (20).

A drive shaft (33) is connected to the rotor (32) and rotates together with the same. The drive shaft (33) vertically penetrates the cylinder chamber (25). Bearing portions (22*a*, 23*a*) for supporting the drive shaft (33) are formed in the front head (22) and the rear head (23), respectively.

An oil supply path (not shown) penetrating the drive shaft (33) in its axial direction is provided in the drive shaft (33). Further, an oil pump (36) is provided at the lower end portion of the drive shaft (33). A lubricant stored in the bottom portion within the casing (10) runs by the oil pump (36) within the oil supply path and supplied to a slide portion of the compression mechanism (20).

An eccentric shaft portion (33*a*) is formed at the portion of the drive shaft (33) within the cylinder chamber (25). The eccentric shaft portion (33*a*) is formed so as to have a larger diameter than other portions of the drive shaft (33) and eccentric by a predetermined amount from the center of axis of the drive shaft (33). The swing piston (28) of the compression mechanism (20) is fitted in a free sliding on the eccentric shaft portion (33*a*).

As shown in FIGS. 2A through 2D, the swing piston (28) is structured such that an annular main body portion (28*a*) is integrally formed with a plate-shaped blade (28*b*) protruding from a position of the outer peripheral surface of the main body portion (28*a*) and extending toward a radially outside. The blade (28*b*) and the main body portion (28*a*) of the swing piston (28) may be formed in an integral part. Alternatively, the blade (28*b*) and the main body portion (28*a*) may be separately formed and then integrally fixed with each other. The main body portion (28*a*) is structured so as to be rotated orbitally within the cylinder chamber (25). The blade (28*b*) is held to be swingable by the cylinder (19).

The swing piston (28) has a non-circular outer peripheral surface configuration and is formed in a so-called ovoid shape. The outer peripheral surface of the swing piston (28) is formed so that the right side portion (28*a*(s)) in the figure with respect to the blade (28*b*) (i.e., the suction side) is even further protruded as compared to the left side portion (28*a*(d)) in the figure (i.e., the discharge side) on a basis of a curved surface configuration such as an ellipse. Further, the outer peripheral surface of the swing piston (28) is formed so that the discharge side (28*a*(d)) with respect to the blade (28*b*) is formed on a basis of a complete round.

The swing piston (28) is structured so that the outer peripheral surface of the ovoid main body portion (28*a*) contacts the inner peripheral surface of the cylinder portion (21) at a point or is adjacent to this point with a minimum clearance therebetween. (In the following description, in order to prevent detailed descriptions, among "contact" and "adjacent", only "contact" will be used.) Unlike the swing piston (28), the inner peripheral surface of the cylinder chamber (25) is not formed in a simple ovoid shape that a complete round is combined with an ellipse but in a configuration on a basis of an envelope curve of the outer peripheral surface of the swing piston (28) when the swing piston (28) swings. Namely, the inner peripheral surface of the cylinder chamber (25) is formed so that especially the portion on the suction side is formed in a deformed curved surface configuration in accordance with the movement of the swing piston (28).

In other words, the outer peripheral surface of the swing piston (28) and the inner peripheral surface of the cylinder chamber (25) are formed so that in substantially overall areas, their gradients of tangents vary continuously and the gradient of tangent on the swing piston (28) side coincides the gradient of tangent on the cylinder chamber (25) side. "Substantially overall areas" used in such structure means as follows. Namely, in conversely speaking, their gradients of tangents may not vary continuously in areas that do not affect the movement of the swing piston. For example, their gradients of tangents may not continuously vary in an area that does not substantially structure the cylinder chamber (25) such as the area between a suction port (41) and a discharge port (42) to be described later.

In accordance with one of characteristics of the present invention, the outer peripheral surface of the swing piston (28) and the inner peripheral surface of the cylinder chamber (25) are formed in configurations that as compared to the case in which these outer and inner peripheral surfaces are formed in a simple circular form, a compression cycle at a time of the movement of the swing piston (28) is shorter and a discharge cycle is longer.

A bush hole (21*b*) with a circular cross-sectional configuration passes through the cylinder portion (21) so as to be parallel to the axial direction of the drive shaft (33). The bush hole (21*b*) is formed at the inner peripheral surface side of the cylinder portion (21) so as to communicate with the cylinder chamber (25) at a part in its peripheral direction. A pair of bushes (51, 52) with a substantially semi-circular cross-sectional configuration is inserted into the bush hole (21*b*). The bushes (51, 52) are formed of a discharge side bush (51) placed at the discharge side of the cylinder chamber (25) and a suction side bush (52) placed at the suction side of the cylinder chamber (25). The blade (28*b*) of the swing piston (28) is inserted into the bush hole (21*b*) of the cylinder portion (21) with these bushes (51, 52) being interposed between the hole and the blade.

The both buses (51, 52) are disposed so that their flat surfaces oppose with each other. The space between these opposing surfaces of the both bushes (52, 52) is formed as a blade groove (29). The blade (28*b*) of the swing piston (28) is inserted into the blade groove (29). The bushes (51, 52) are formed so that the blade (28*b*) advances and retreats in the blade groove (29) in the direction of the surface of the blade (28*b*) while being engaged with the blade groove (29). The bushes (51, 52) are structured so as to swing within the bush hole (21*b*) integrally with the blade (28*b*).

Although the case that the both bushes (51, 52) are separate members is described in this embodiment, the both bushes (51, 52) may be formed integrally.

When the drive shaft (33) is rotated, the blade (28*b*) is advanced and retreated within the blade groove (29) and the swing piston (28) is swung with a point on the cylinder side being a center of axis (a center of the bush hole (21*b*)). By such swing movement, the contact point of the swing piston (28) with the inner peripheral surface of the cylinder portion (21) is successively moved clockwise as shown in FIGS. 2A to 2D. At this time, the swing piston (28) (the main portion (28*a*)) is rotated orbitally about the drive shaft (33) but not rotated on its own axis.

Figure 2:
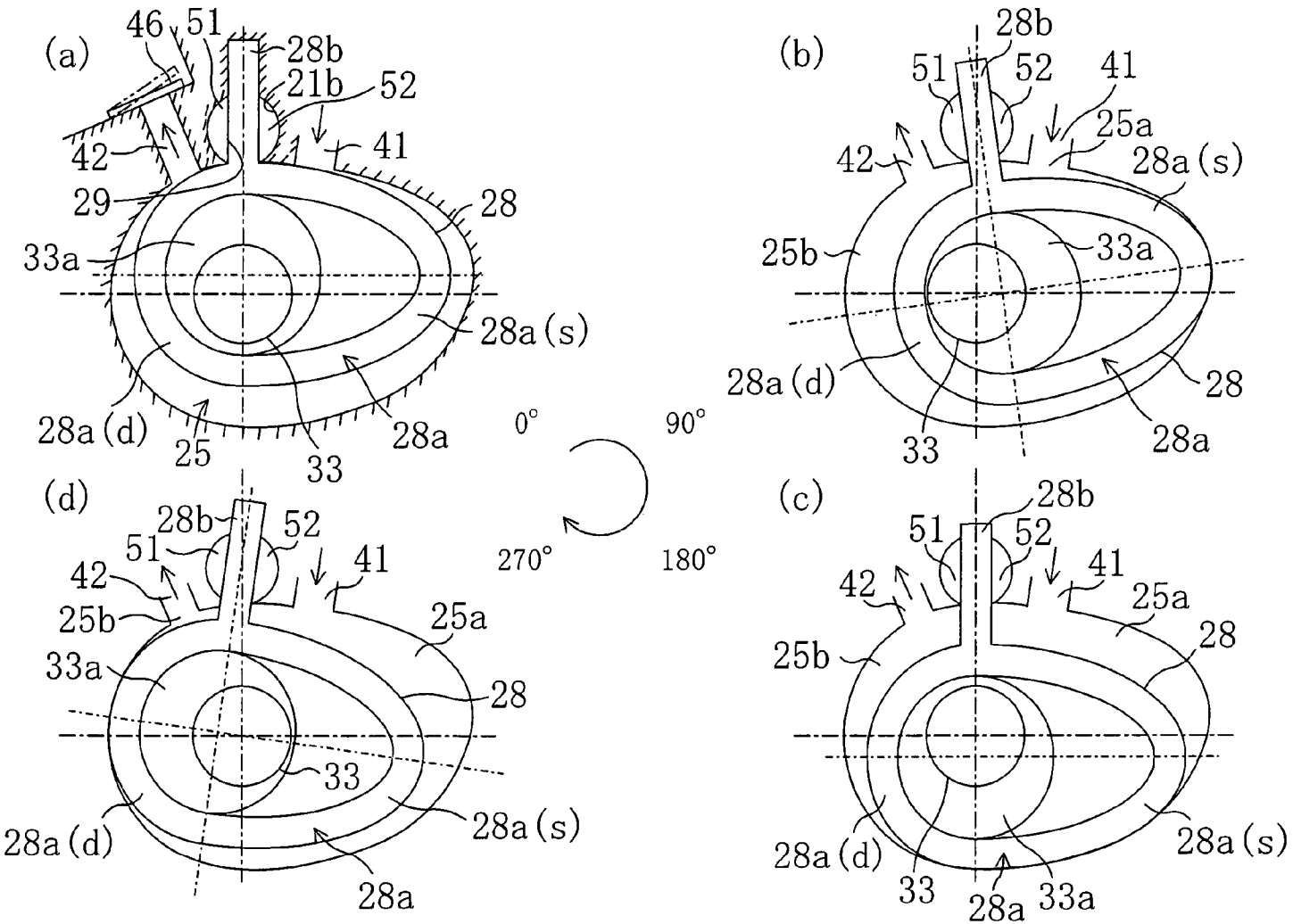
FIGS. 2A to 2D are cross-sectional views illustrating cross-sectional configurations and movement s of a compression mechanism.

As shown in FIG. 2C, for example, the blade (28*b*) divides the cylinder chamber (25) into the suction chamber (25*a*) and the compression chamber (25*b*). A suction port (41) is formed in the cylinder portion (21). The suction port (41) penetrates the cylinder portion (21) in a radial direction thereof and is opened so that its one end faces the suction chamber (25*a*). Connected to the other end of the suction portion (41) is an end portion of the suction pipe (14).

A discharge port (42) is also formed in the cylinder portion (21). The discharge port (42) penetrates the cylinder portion (21) in a radial direction thereof and is opened so that its one end faces the compression chamber (25*b*). The other end of the discharge port (42) communicates with a discharge space within the casing (10) via a discharge valve (46) for opening/closing the discharge port (42) (see FIG. 2A).

<Compression Movement >

Next, the operation of the swing compressor (1) will be described.

When the compressor motor (30) is activated and the rotor (32) is rotated, the rotation of the rotor (32) is transmitted via the drive shaft (33) to the swing piston (28) of the compression mechanism (20). Then, the blade (28*b*) of the swing piston (28) slides with respect to the bushes (51, 52) as a reciprocating linear movement, and the bushes (51, 52) are reciprocally rotated within the bush hole (21*b*). As a result, in the swing piston (28), the blade (28*b*) is swung about the bush hole. (21*b*) and the main body portion (28*a*) is rotated orbitally about the drive shaft (33) within the cylinder chamber (25). Then, the compression mechanism (20) performs a predetermined compression movement.

Specifically, as shown in FIG. 2B, a description will be firstly given of the state that the inner peripheral surface of the cylinder portion (21) contacts the outer peripheral surface of the swing piston (28) at a point on the immediate right side of the suction port (41).

Under such state, the volume of the suction chamber (25*a*) of the cylinder chamber (25) is approximately minimized. When the swing piston (28) is rotated orbitally clockwise in the figure, the volume of the suction chamber (25*a*) is gradually increased and a gas refrigerant with low pressure is suctioned via the suction port (41) into the suction chamber (25*a*). In accordance with this suction cycle, when the swing piston (28) is placed at a bottom dead center as shown in FIG. 2C, the volume of the suction chamber (25*a*) is larger than that of the compression chamber (25*b*).

When the swing piston (28) continues to be rotated orbitally, the volume of the suction chamber (25*a*) is further increased and the contact position of the inner peripheral surface of the cylinder portion (21) with the outer peripheral surface of the swing piston (28) reaches the suction port (41), the suction chamber (25*a*) now becomes the compression chamber (25*b*) for compressing a refrigerant. Then, a new suction chamber (25*a*) is formed by being isolated by the blade (28*b*).

When the swing piston (28) is further rotated, the volume of the compression chamber (25*b*) is reduced while a refrigerant being repeatedly suctioned into the suction chamber (25*a*). In the compression chamber (25*b*), the refrigerant is compressed. When the pressure within the compression chamber (25*b*) reaches a predetermined value and the differential pressure between the outside of the compression mechanism (20) and the inside thereof reaches a set value, the discharge valve (46) is opened by a refrigerant with high pressure and the refrigerant with high pressure is discharged from the compression chamber (25*b*) into the casing (10). Such movements are repeated.

Figure 3:
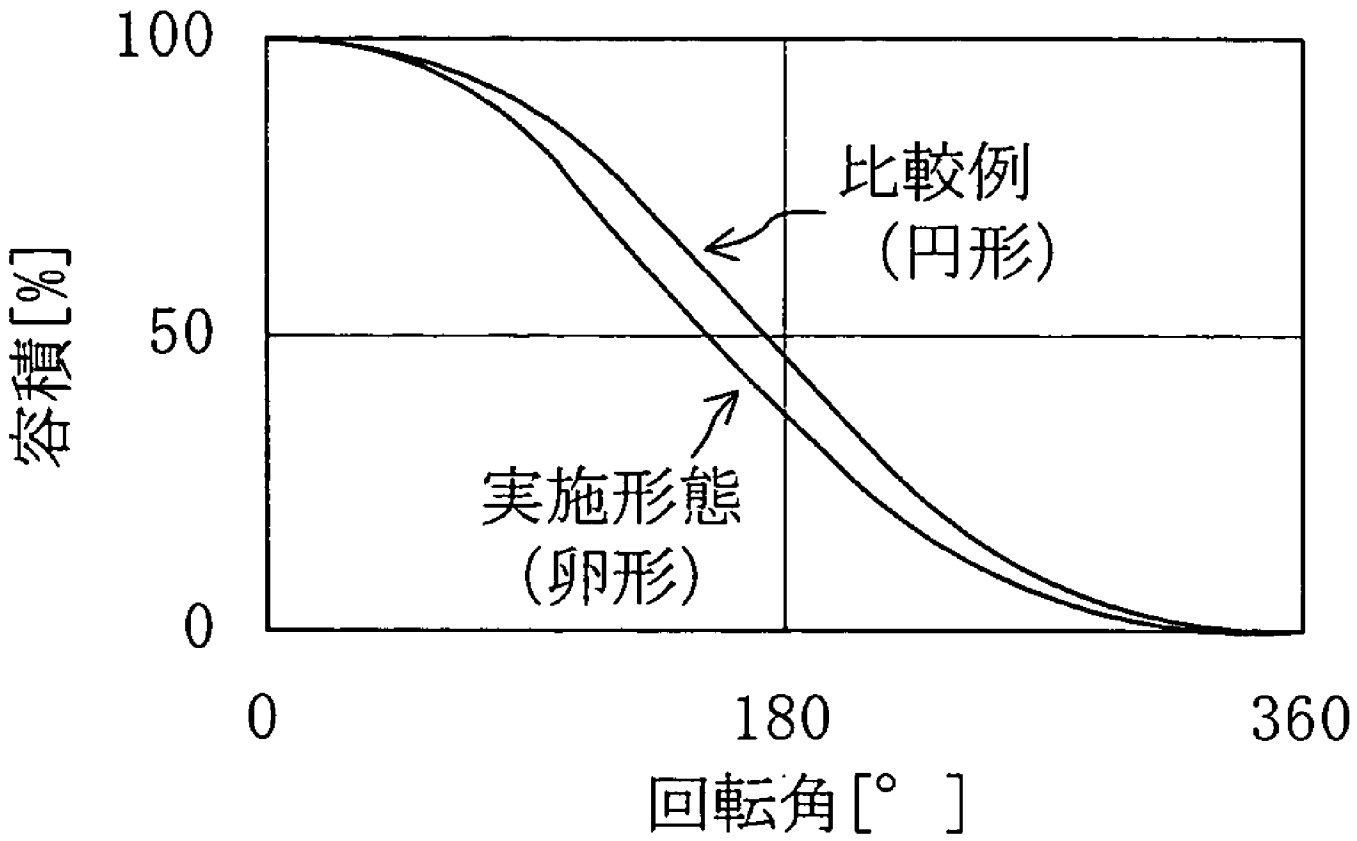
FIG. 3 is a graph illustrating volume variation of a cylinder chamber in the swing compressor of the first embodiment.

In accordance with the first embodiment, as described above, when the swing piston (28) is placed at a bottom dead center as shown in FIG. 2C, the volume of the suction chamber (25*a*) is larger than that of the compression chamber (25*b*). Accordingly, as shown in FIG. 3 that illustrates variations of the volume of the cylinder chamber, in the case of a comparative example that the swing piston (28) has a circular form, 50% of volume variation is obtained substantially at the position of bottom dead center (180°). On the other hand, in the case of this first embodiment that the swing piston (28) has an ovoid shape, 50% of volume variation is obtained well before reaching the bottom dead center.

Thus, in accordance with this embodiment, the pressure within the compression chamber (25*b*) reaches a discharge pressure earlier as compared to the comparative example. For this reason, a discharge cycle is performed for a longer time as compared to the comparative example. Further, as the discharge cycle is performed for a relatively long time, the flow rate of a discharged gas is decreased and a discharge resistance is also decreased. Consequently, in accordance with the first embodiment, as compared to the case that a circular swing piston is used, a peak pressure is decreased and overcompression of a refrigerant seldom occurs.

<Effects of the First Embodiment>

As described above, in accordance with the first embodiment, the outer peripheral surface of the swing piston (28) is formed in a non-circular form and the inner peripheral surface of the cylinder chamber (25) is formed in a conformable configuration with the outer peripheral surface. Namely, the outer peripheral surface and the inner peripheral surface are formed in configurations that a compression cycle ends earlier and a discharge cycle is performed for a longer time as compared to the case in which these surfaces are formed in a circular form. Thus, overcompression of a refrigerant is suppressed and a power loss can be minimized. As a result, a decrease in a compression efficiency can be prevented.

In accordance with the first embodiment, the inner peripheral surface of the cylinder chamber (25) is formed on a basis of an envelope curve obtained when the swing piston (28) is swung. In contrast, for example, when the inner peripheral surface of the cylinder chamber (25) is formed in a configuration that a complete round is combined with an ellipse as the outer peripheral surface of the piston (28), portions that a gradient of tangent of elliptical portion of the swing piston (28) does not coincide that of the cylinder chamber (25) when the swing piston(28) is swung may be generated. Thus, sealing is impossible and the compressor cannot be operated. In accordance with this embodiment, however, as the cylinder chamber (25) is formed in the above-described configuration, the swing piston (28) can be smoothly operated and an excellent sealing property can be ensured.

Further, in accordance with the first embodiment, the outer peripheral surface of the swing piston (28) on the discharge side with respect to the blade (28*b*) is formed on a basis of a complete round. Generally, in the cylinder chamber (25), as the swing piston (28) is moved to the discharge side (e.g., the state shown in FIG. 2D), the differential pressure between the suction chamber (25*a*) and the compression chamber (25*b*) becomes larger and thus a sealing property is much required. If the outer peripheral surface of the swing piston (28) on the discharge side is formed in a non-circular form, accuracy of forms of the swing piston (28) and the cylinder chamber (25) cannot be obtained easily and thus a sealing property is apt to be decreased. In contrast, in accordance with the first embodiment, the outer peripheral surface of the swing piston (28) on the discharge side is formed in a complete round configuration, required accuracy of form can be easily obtained and a sealing property can be improved.

If the overall swing piston (28) is formed in a circular form, as compared to the first embodiment, a discharge cycle becomes shorter and the flow rate of a discharged gas is increased and thus a peak pressure is also increased. Further, the pulsating of discharge pressure becomes relatively large, torque variations and vibrations become larger and noises are easily generated. In contrast, in accordance with the first embodiment, such problems can be solved. Namely, torque variations, vibrations and noises can be suppressed.

Second Embodiment

Figure 4:
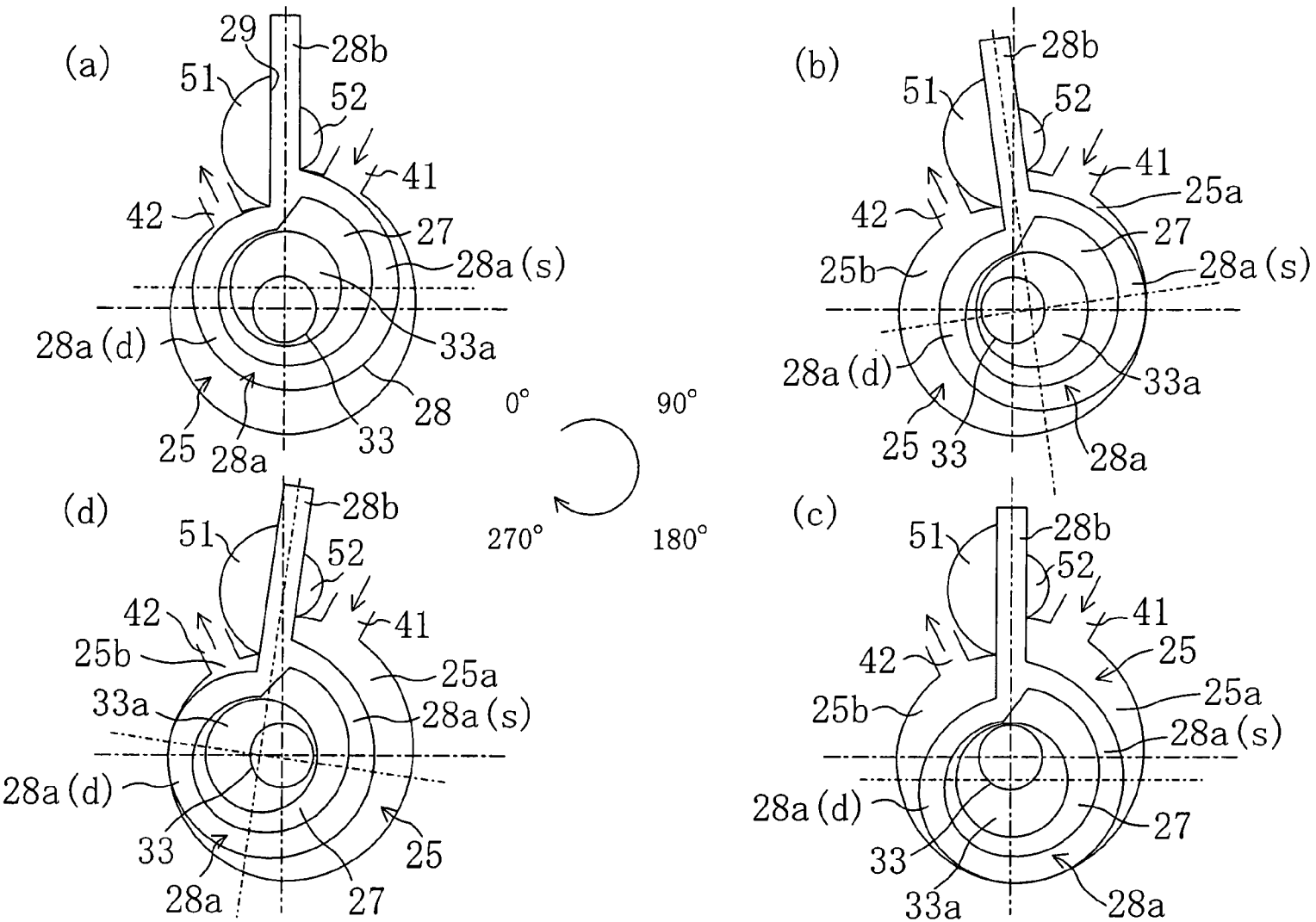
FIGS. 4A to 4D are cross-sectional views illustrating cross-sectional configurations and movements of a compression mechanism in a swing compressor of an second embodiment of the present invention.

Next, a second embodiment of the present invention will be described. In accordance with the second embodiment, as shown in FIG. 4, the outer peripheral surface of the swing piston (28) and the inner peripheral surface of the cylinder chamber (25) are formed in different configurations from those of the first embodiment.

The outer peripheral surface of the swing piston (28) of the second embodiment is formed on a basis of a spiral configuration such as an involute curve so that the radius of the swing piston (28) is reduced from the suction side (28*a*(s)) with respect to the blade (28*d*) to the discharge side (28*a*(d)).

The inner peripheral surface of the cylinder chamber (25) is formed in a configuration that a gradient obtained by the swing movement of the swing piston (28) is added into an involute curve. Namely, also in this embodiment, the inner peripheral surface of the cylinder chamber (25) is formed on a basis of an envelope curve obtained when the swing piston is swung.

In accordance with the second embodiment, the width of the surface of the blade (28*b*) on the suction side (i.e., the length of the blade (28*b*) in the radial direction of the swing piston (28)) is shorter than that of the surface on the discharge side. For this reason, the dimensional different between such surfaces is absorbed by using bushes (51, 52) with different diameters. Further, a spacer (27) is mounted between the eccentric shaft portion (33*a*) and the main body portion (28*a*) of the swing piston (28) so as to be embedded into the space therebetween. The spacer (27) may be formed integrally with the main body portion of the swing piston (28) or may be formed separately therefrom. In this regard, the second embodiment is the same as the first embodiment.

Other structures of the second embodiment are the same as those of the first embodiment.

In accordance with the second embodiment, when the compressor motor (30) is activated, in accordance with the drive shaft (33) being rotated, the blade (28*b*) is advanced and retreated within the blade groove (29) while being swung about the bushes (51, 52) and the main body portion (28*a*) of the swing piston (28) is rotated orbitally about the drive shaft (33) as shown in FIGS. 4A to 4D.

In the cylinder chamber (25), suction of a refrigerant at the suction chamber (25*a*) and compression/discharge of the refrigerant at the compression chamber (25*b*) are repeated, and the compressor is operated by the same manner as that of the first embodiment.

Also, in accordance with the second embodiment, as shown in FIG. 4C, the volume of the suction chamber (25*a*) is larger than that of the compression chamber (25*b*) when the swing piston (28) reaches a bottom dead center. Accordingly, as compared to the case of a circular swing piston, a compression cycle ends earlier and a discharge cycle is performed for a longer time. For this reason, as in the first embodiment, the flow rate of a discharged gas is decreased and a resistance is also decreased, so that overcompression is reduced as compared to the case of using a circular swing piston. As a result, as compared to conventional examples, a power loss can be minimized and a decrease in a compression efficiency can be prevented. Namely, an improvement in performance can be accomplished.

By the swing piston (28) being formed along an involute curve, working for the piston can be easily performed as compared to an ovoid piston.

Third Embodiment

Next, a third embodiment of the present invention will be described.

A swing compressor of the third embodiment has the same basic structure as the swing compressor (1) of the first embodiment except for a part of the swing piston (28). Thus, descriptions of other portions except for the swing piston (28) will be omitted in the third embodiment.

Figure 5:
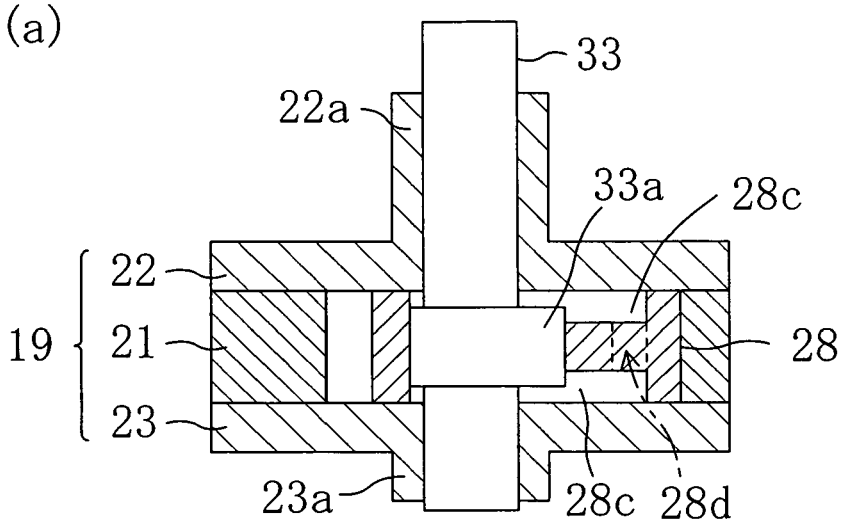
FIG. 5A is a cross-sectional view of a main portion in a swing compressor relating to an third embodiment of the present invention.
FIG. 5B is a view illustrating the configuration of a swing piston in the swing compressor relating to the third embodiment of the present invention.
FIG. 5C shows a modified example of FIG. 5B in the swing compressor relating to the third embodiment of the present invention.
Figure 5:
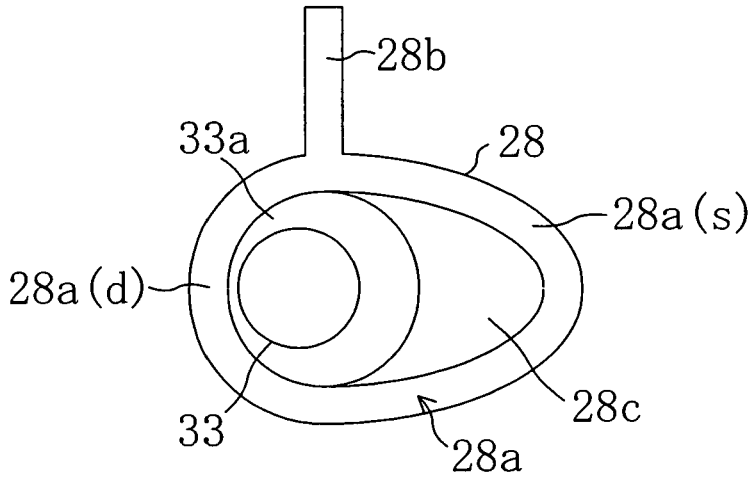
Figure 5:
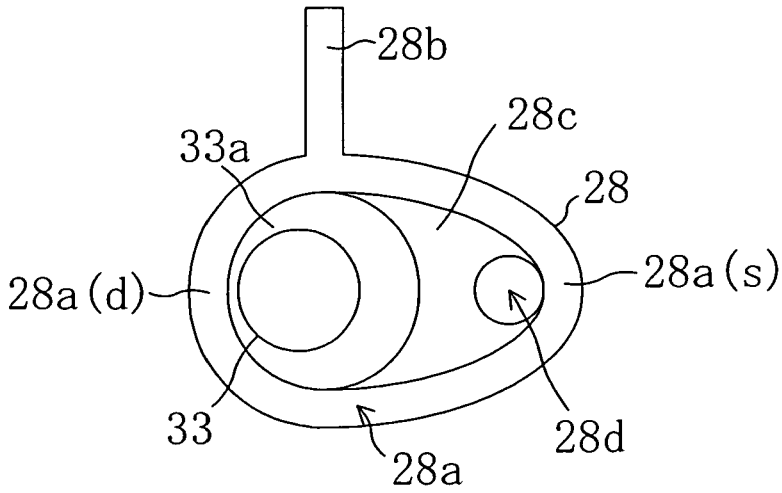

As shown in FIGS. 5A and 5B, clearance portions (28*c*) are formed by counter boring on surfaces of the swing piston (28) of the third embodiment on the front head (22) side and the rear head (23) side. Each clearance portion (28*c*) is formed at the suction side (28*a*(s)) of the swing piston (28) even further protruding than the discharge side (28*a*(d)) thereof and not formed at the discharge side (28*a*(d)).

Although materials for the swing piston (28) are not specified in the above-described embodiments, metallic materials with small specific gravity including an aluminum with smaller specific gravity than steel materials used for the drive shaft (33) or synthetic resin materials are used for the swing piston (28) of the third embodiment. Such materials may be used in the embodiments 1 and 2.

In accordance with the third embodiment, in addition to that a cycle for discharging a refrigerant is extended by the same actions as in the first embodiment and thus overcompression is suppressed, by reducing the specific gravity of the swing piston (28) and forming the clearance portion (28*c*), the balance of the swing piston (28) during its movement is improved and a stable movement is possible.

<Modified Example of the Third Embodiment>

FIG. 5C shows a modified example of the third embodiment.

In accordance with this example, a through-hole (28*d*) as well as the counter borings (28*c*) is formed as the clearance portion (28*c*) at the suction side (28*a*(s)) of the swing piston (28) even further protruding than the discharge side (28*a*(d)). Other structures are the same as in the examples shown in FIGS. 5A and 5B.

Because of such structure, the mass of the suction side (28*a*(s)) of the swing piston (28) becomes even further smaller and thus stability of movement during the operation of the compressor can be further improved.

Fourth Embodiment

Next, an fourth embodiment of the present invention will be described.

Figure 6:
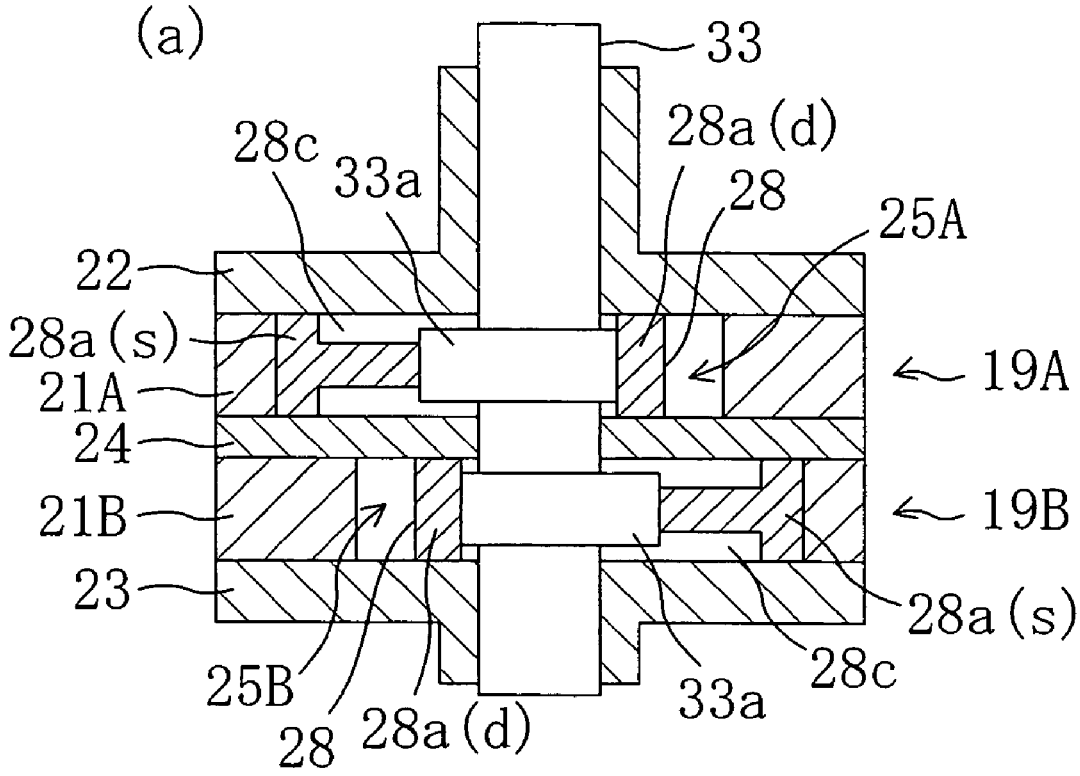
FIG. 6 is a cross-sectional view of a main portion of a swing compressor relating to an fourth embodiment of the present invention.

In accordance with the fourth embodiment, as shown in FIG. 6, two cylinders (19A, 19B) are concentrically disposed. The cylinders (19A, 19B) respectively have the ovoid swing pistons (28, 28) that are the same as in the first embodiment and cylinder chambers (25A, 25B) with conformable configurations with the swing pistons. The clearance portions (28*c*) are formed at the suction side (28*a*(s)) of each of the swing pistons (28, 28) on the upper surface side of each of the swing pistons (28, 28) and the lower surface side thereof.

In accordance with one of characteristics of the present invention, the swing pistons (28, 28) are disposed at positions that the suction side (28*a*(s)) of one swing piston is phase-shifted by 180° from the suction side (28*a*(s)) of the other swing piston. Namely, two swing pistons (28, 28) are rotated while their suction sides (28*a*(s)) always opposing with each other at 180° with respect to a center of rotation of the drive shaft (33).

Other portions have the same structures as in the above-described embodiments.

In accordance with the fourth embodiment, the suction sides (28*a*(s)) of the swing pistons (28, 28) are disposed so as to oppose with each other with a center of rotation of the drive shaft (33) being interposed therebetween. This relationship is always maintained even if the drive shaft (33) is rotated. Accordingly, the balance of the drive shaft (33) during its rotation is excellent. Thus, as compared to the third embodiment, even further stabilized movement is possible.

Fifth Embodiment

Next, an fifth embodiment of the present invention will be described.

In accordance with the fifth embodiment, the configurations of the drive shaft (33) and the swing piston (28) are partially changed in the swing compressor of the third embodiment.

Figure 7:
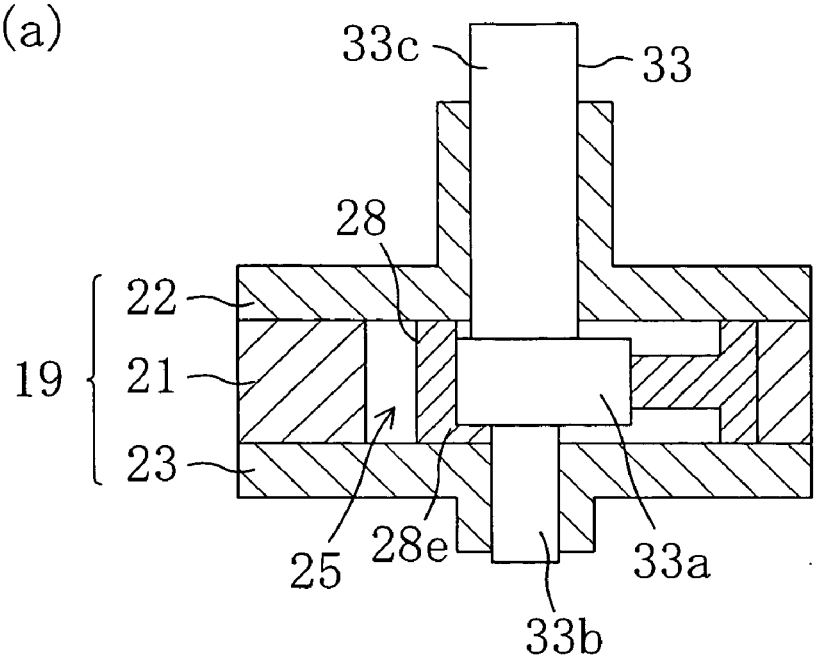
FIG. 7A is a cross-sectional view of a main portion of a swing compressor relating to an fifth embodiment of the present invention.
FIG. 7B is a view illustrating the configuration of a swing piston of the swing compressor relating to the fifth embodiment.
Figure 7:
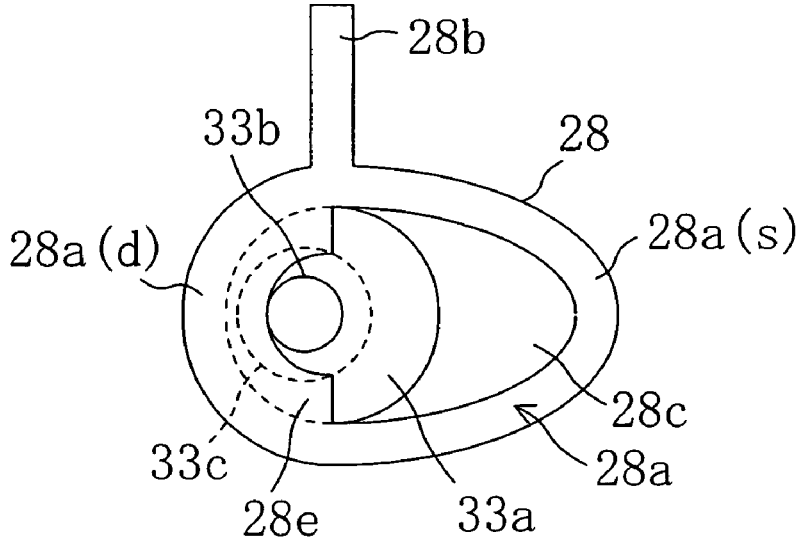
Figure 8:
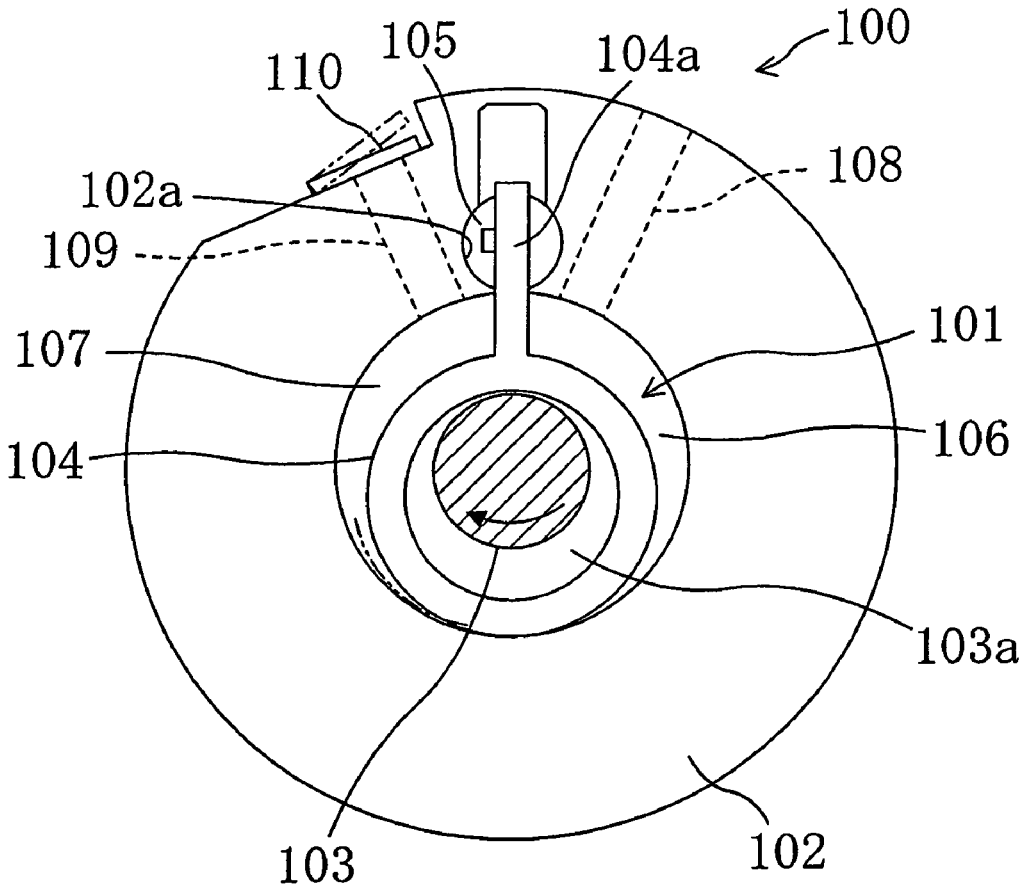
FIG. 8 (Prior Art)
FIG. 8 is a view illustrating configurations of a cylinder and a swing piston in a conventional swing compressor.
Figure 3:
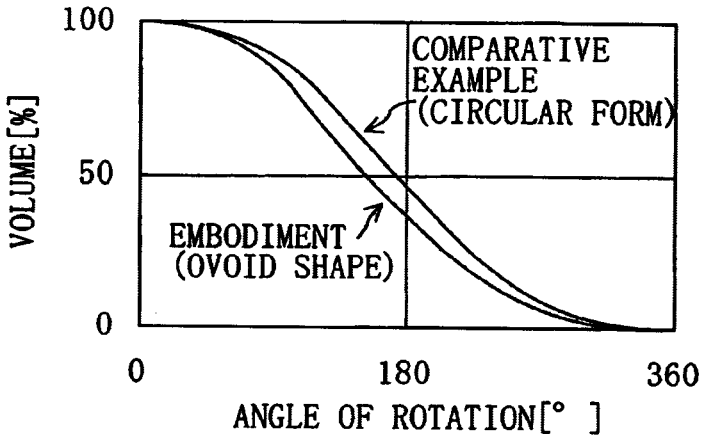

Specifically, as shown in FIGS. 7A and 7B, the axial direction length of the eccentric shaft portion (33*a*) is shorter than that of the cylinder chamber (25). Further, the lower portion of the drive shaft (33) serving as a sub-shaft (33*b*) has a smaller diameter than the upper portion thereof serving as a main-shaft (33*c*). A swelling portion (28*e*) protruding in a radial internal direction is formed at the discharge side (28*a*(d)) of the swing piston (28) on the surface of the rear head (23). The swelling portion (28*e*) functions as a balance weight during the movement of the swing piston (28).

When the same operations as in the third embodiment shown in FIGS. 5A to 5C are performed in the fifth embodiment, the movement of the swing piston (28) is even further stabilized because of the balance weight (28*e*). Accordingly, more stable movement of the swing compressor (1) can be accomplished.

Although the balance weight (28*e*) integrally formed with the swing piston (28) is illustrated in the figures, the balance weight (28*e*) separately formed from the swing piston (28) may be fixed thereto. In that case, the specific gravity and the size of the balance weight (28*e*) are preferably set depending on the balance of the mass of the swing piston (28). Alternatively, the balance weight (28*e*) may be provided at both of the rear head (23) side and the front head (22) side of the swing piston (28).

Other Embodiments

For the above-described embodiments, the present invention may be structured as follows.

The outer peripheral surface of the swing piston (28) is formed in an ovoid shape that a complete round is combined with an ellipse in the first embodiment and in a configuration on a basis of an involute curve in the second embodiment. Nevertheless, the outer peripheral surface of the swing piston (28) may be formed in other configuration as long as a shorter compression cycle and a longer discharge cycle can be obtained as compared to the case of the ovoid shape.

Further, the cylinder chamber (25) may not be formed in a configuration on a basis of an envelope curve of the configuration of the swing piston (28). The cylinder chamber (25) may be considered to be movable in a relative movement of the swing piston (28) and the cylinder chamber (25). Then, the swing piston (28) may be formed in a configuration on a basis of an envelope curve of the configuration of the cylinder chamber (25).

The inner peripheral surface of the cylinder chamber (25) is formed in a non-circular form. Then, the outer peripheral surface of the swing piston (28) is formed in a configuration on a basis of an envelope curve of the inner peripheral surface of the cylinder chamber (25) that is obtained by the relative movement thereof when the swing piston (28) is swung. Thus, the outer peripheral surface of the swing piston (28) and the inner peripheral surface of the cylinder chamber (25) may be formed in configurations that a shorter compression cycle and a longer discharge cycle can be obtained during the movement of the swing piston (28) as compared to the case in which the peripheral surfaces are formed in a circular form.

Consequently, the inner peripheral surface of the cylinder chamber (25) may be formed on a basis of an ellipse or an involute curve and the piston (28) may be formed in conformable with the configuration of the cylinder chamber. Also in this case, the same effects as those of the respective embodiments can be exhibited.

Moreover, two swing pistons (28) of the second embodiment formed on a basis of an involute curve may be coaxially disposed. The swing piston (28) of the second embodiment may be provided with the clearance portion (28*c*, 28*d*) and the balance weight (28*e*).

INDUSTRIAL APPLICABILITY

As described above, the present invention is useful for a rotary compressor.

What is claimed is:

1. A rotary compressor comprising:

a compression mechanism including a cylinder and a swing piston which is rotated orbitally within a cylinder chamber; and a blade integrally formed with the swing piston and configured to be swung by the cylinder, the cylinder chamber being divided into a suction chamber and a compression chamber by the blade with a volume of the suction chamber being larger than a volume of the compression chamber when the swing piston is placed at a bottom dead center, the swing piston having a non-circular outer peripheral surface and the cylinder chamber having an inner peripheral surface configured on a basis of an envelope curve of the outer peripheral surface of the swing piston when the swing piston swings, the outer peripheral surface of the swing piston and the inner peripheral surface of the cylinder chamber having non-circular cross sectional shapes as viewed perpendicular to a longitudinal axis of the cylinder, the blade having a longitudinal axis that is centered on the blade and extends through the non-circular cross sectional shape of the swing piston, a first portion of the swing piston located on a suction chamber side extending away from the longitudinal axis in a first direction and a second portion of the swing piston located on a compression chamber side extending away from the longitudinal axis in a second direction, and the first portion extending farther away from the longitudinal axis in the first direction than the second portion extends in the second direction throughout an entire orbital rotation of the swing piston.

2. The rotary compressor of claim 1, wherein the outer peripheral surface of the swing piston is formed so that the second portion is formed on a basis of a complete round.

3. The rotary compressor of claim 1, wherein the outer peripheral surface of the swing piston is formed on a basis of a spiral configuration so that its diameter is gradually reduced from the first portion to the second portion.

4. The rotary compressor of claim 3, wherein the outer peripheral surface of the swing piston is formed on a basis of an involute curve.

5. The rotary compressor of any one of claims 2 to 4, wherein the swing piston is provided with a clearance portion at the first portion even further extending than the second portion.

6. The rotary compressor of any one of claims 2 to 4, wherein the swing piston is provided with a balance weight at the second portion less extending than the first portion.

7. The rotary compressor of any one of claims 2 to 4, wherein two swing pistons are disposed along a direction of a shaft axis of a shaft so that first portions oppose each other with respect to a center of the shaft.

8. A rotary compressor comprising:

a compression mechanism including a cylinder and a swing piston which is rotated orbitally within a cylinder chamber; and a blade integrally formed with the swing piston and configured to be swung by the cylinder, the cylinder chamber being divided into a suction chamber and a compression chamber by the blade with a volume of the suction chamber being larger than a volume of the compression chamber when the swing piston is placed at a bottom dead center, the cylinder chamber having a non-circular inner peripheral surface and the swing piston having an outer peripheral surface configured on a basis of an envelope curve of the inner peripheral surface of the cylinder chamber when the swing piston swings, the outer peripheral surface of the swing piston and the inner peripheral surface of the cylinder chamber having non-circular cross sectional shapes as viewed perpendicular to a longitudinal axis of the cylinder, the blade having a longitudinal axis that is centered on the blade and extends through the non-circular cross sectional shape of the swing piston, a first portion of the swing piston located on a suction chamber side extending away from the longitudinal axis in a first direction and a second portion of the swing piston located on a compression chamber side extending away from the longitudinal axis in a second direction, and the first portion extending farther away from the longitudinal axis in the first direction than the second portion extends in the second direction throughout an entire orbital rotation of the swing piston.

* * * * *

UNITED STATES PATENT AND TRADEMARK OFFICE

CERTIFICATE OF CORRECTION

PATENT NO. : 7,029,252 B2
APPLICATION NO. : 10/467279
DATED : April 18, 2006
INVENTOR(S) : Masanori Masuda et al.

It is certified that error appears in the above-identified patent and that said Letters Patent is hereby corrected as shown below:

Replace fig. 3 with attached fig. 3

FIG. 3

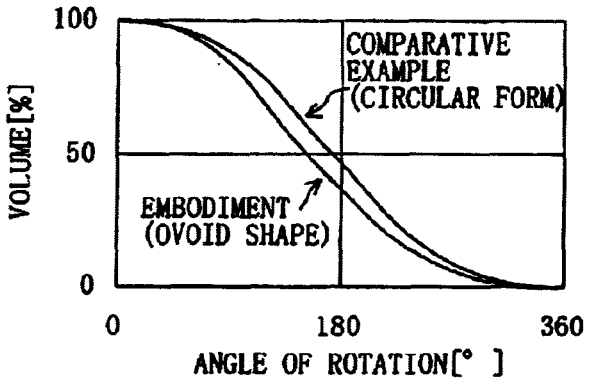

Signed and Sealed this

Twenty-fourth Day of October, 2006

JON W. DUDAS
*Director of the United States Patent and Trademark Office*